US008677536B2

(12) United States Patent
Douglas

(10) Patent No.: US 8,677,536 B2
(45) Date of Patent: Mar. 25, 2014

(54) METHOD AND APPARATUS FOR SENSING FOOT RETRACTION IN A MATTRESS REPLACEMENT SYSTEM

(75) Inventor: Stephen L. Douglas, Batesville, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 853 days.

(21) Appl. No.: 12/621,019

(22) Filed: Nov. 18, 2009

(65) Prior Publication Data

US 2011/0113561 A1 May 19, 2011

(51) Int. Cl.
*A61G 7/00* (2006.01)

(52) U.S. Cl.
USPC ..... 5/713; 5/706; 5/714

(58) Field of Classification Search
USPC ..... 5/706, 713, 714, 715, 690
See application file for complete search history.

(56) References Cited

U.S. PATENT DOCUMENTS

| | | | |
|---|---|---|---|
| 5,083,332 | A | 1/1992 | Foster et al. |
| 5,179,744 | A | 1/1993 | Foster et al. |
| 5,377,370 | A | 1/1995 | Foster et al. |
| 5,647,079 | A | 7/1997 | Hakamiun et al. |
| 5,715,548 | A | 2/1998 | Weismiller et al. |
| 6,021,533 | A | 2/2000 | Ellis et al. |
| 6,163,903 | A | 12/2000 | Weismiller et al. |
| 6,212,714 | B1 | 4/2001 | Allen et al. |
| 6,295,675 | B1 | 10/2001 | Ellis et al. |
| 6,357,065 | B1 | 3/2002 | Adams |
| 6,467,113 | B2 | 10/2002 | Ellis et al. |
| 6,496,993 | B2 | 12/2002 | Allen et al. |
| 6,611,979 | B2 | 9/2003 | Welling et al. |
| 6,684,427 | B2 | 2/2004 | Allen et al. |
| 6,760,939 | B2 | 7/2004 | Ellis et al. |
| 6,957,461 | B2 | 10/2005 | Osborne et al. |
| 7,000,272 | B2 | 2/2006 | Allen et al. |
| 7,111,348 | B2 | 9/2006 | Ellis et al. |
| 7,216,384 | B2 | 5/2007 | Allen et al. |
| 7,237,284 | B2 | 7/2007 | Hensley et al. |
| 7,260,860 | B2 | 8/2007 | Chambers et al. |
| 7,296,312 | B2 | 11/2007 | Menkedick et al. |
| 7,353,556 | B2 | 4/2008 | Ellis et al. |
| 7,363,663 | B2 | 4/2008 | Chambers et al. |
| 7,398,573 | B2 | 7/2008 | Ellis et al. |
| 7,406,729 | B2 | 8/2008 | Hornbach et al. |
| 7,426,760 | B2 | 9/2008 | Vrzalik |
| 7,464,425 | B2 | 12/2008 | Chambers et al. |
| 7,469,436 | B2 | 12/2008 | Meyer et al. |
| 7,520,006 | B2 | 4/2009 | Menkedick et al. |
| 7,523,515 | B2 | 4/2009 | Allen et al. |
| 7,565,710 | B2 | 7/2009 | Chambers et al. |
| 2004/0177445 | A1 | 9/2004 | Osborne et al. |
| 2006/0026767 | A1 | 2/2006 | Chambers et al. |
| 2006/0075559 | A1 | 4/2006 | Skinner et al. |
| 2006/0112489 | A1 | 6/2006 | Bobey et al. |
| 2006/0179579 | A1 | 8/2006 | Phillips et al. |
| 2007/0169271 | A1 | 7/2007 | Allen et al. |
| 2007/0235036 | A1 | 10/2007 | Bobey et al. |

(Continued)

*Primary Examiner* — Peter M Cuomo
*Assistant Examiner* — Brittany Wilson
(74) *Attorney, Agent, or Firm* — Barnes & Thornburg LLP

(57) ABSTRACT

A patient support surface, such as a mattress, includes one or more sensors to sense movement of at least a portion of the mattress caused by extension or retraction of an associated mattress support section of a bed frame. A pneumatic control system adjusts inflation and/or deflation of at least one inflatable bladder of the mattress in response to a signal received from the one or more sensors.

13 Claims, 7 Drawing Sheets

(56) References Cited

U.S. PATENT DOCUMENTS

| | | | | |
|---|---|---|---|---|
| 2008/0028533 | A1 | 2/2008 | Stacy et al. | |
| 2008/0209635 | A1 | 9/2008 | Gonzalez et al. | |
| 2008/0216248 | A1 | 9/2008 | Phillips et al. | |
| 2009/0056027 | A1 | 3/2009 | Ball et al. | |
| 2009/0119846 | A1 | 5/2009 | Meyer et al. | |
| 2009/0144909 | A1 | 6/2009 | Skinner et al. | |
| 2009/0217460 | A1 | 9/2009 | Bobey et al. | |
| 2011/0162145 | A1 * | 7/2011 | Osborne et al. | 5/618 |

* cited by examiner

METHOD AND APPARATUS FOR SENSING FOOT RETRACTION IN A MATTRESS REPLACEMENT SYSTEM

BACKGROUND

The present disclosure relates to support surfaces, such as mattresses, on which patients are supported in hospitals, acute care facilities, and other patient care environments. More particularly, the present disclosure relates to adjustable support surfaces that are configured to accommodate and operate with a variety bed frames having sections that extend and retract.

Hospital bed frames with extendable and retractable foot sections are well-known in the art of patient supports. The Hill-Rom TotalCare® and VersaCare® beds are examples of hospital beds that offer extendable and retractable foot sections. Additionally, bed frames having retracting side sections are known and one example of such a bed frame is the Hill-Rom Excel Care® bariatric bed.

Often, hospital bed frames with integrated mattresses also have an integrated control system to control bed frame functions and mattress functions. Such integrated control systems operate to inflate or deflate bladders of the mattress concurrently with the extension or retraction of one or more hospital bed frame sections. Overrun or billowing of the mattress is avoided by coordinating the retraction of both the bed frame section and the associated mattress section. Concurrent retraction also may facilitate more consistent interface pressures between the mattress section and the patient.

Mattress replacement systems are sometimes used to replace existing mattresses on bed frames. This may done to change the type of mattress functionality available on the bed frame or simply to replace an old or worn out mattress. Thus, there is a possibility that, sometimes, a caregiver or hospital administrator may want to use a hospital bed frame that includes an extendable and retractable section in conjunction with a mattress that is not controlled by the hospital bed frame controller. In prior art systems, the incompatible mattress may possibly overrun the edges or ends of the hospital bed or the replacement surface may billow when the supporting hospital bed section retracts. Thus, there is a need for a mattress replacement system that has its own bladder inflation control system but that can be used on hospital bed frames having one or more extendable and retractable bed frame sections.

SUMMARY

The present invention comprises one or more of the features recited in the appended claims and/or the following features which, alone or in any combination, may comprise patentable subject matter:

A support surface or mattress for use on a bed frame having mattress support sections may include an extendable and retractable foot section. The mattress may comprise a cover having an interior region, an inflatable bladder situated in the interior region, a pneumatic controller configured to inflate and deflate the at least one inflatable bladder, and a sensor situated in the interior region. The sensor may output a signal indicative that a force is being applied to the mattress in response to at least one mattress support section being extended or retracted. The signal may be communicated to the pneumatic controller which may inflate or deflate the at least one inflatable bladder in response to the signal.

The inflatable bladder or bladders may extend upwardly along a vertical axis, the vertical axis of the inflatable bladder or bladders being substantially perpendicular to a bottom surface of the cover. In other embodiments, the inflatable bladder or bladders may extend laterally along a horizontal axis. The sensor may be located beneath the at least one inflatable bladder. The sensor may be operable to signal the pneumatic controller that movement of a foot portion of the cover has been caused by movement of the bed frame to extend or to retract the foot section. The pneumatic controller may operate to inflate or deflate the inflatable bladder in a foot section of the mattress in response to receipt of the signal.

In some embodiments, the sensor may comprise a string potentiometer. In some embodiments, the pneumatic controller may include a valve box situated in the interior region of the mattress and the string potentiometer may include a housing coupled to the valve box. In some embodiments, the mattress may include a mounting plate coupled to a foot end wall or panel of the cover. The string potentiometer may have a string extending from the housing and attached to the mounting plate or to the bottom layer of the foot end wall of the cover.

In some embodiments, the sensor may comprise a Hall Effect sensor and a magnet. The sensor may further include a retractable housing coupled to the Hall Effect sensor and the magnet. The retractable housing may have a first end adjacent a foot end wall or panel of the cover. In some embodiments, the pneumatic controller may comprise a valve box situated in the interior region of the cover and the retractable housing may be situated between the valve box and a foot end wall or panel of the cover. In some embodiments, the sensor may comprise a telescopic housing and multiple Hall Effect sensors. In some instances, a respective Hall Effect sensor may be mounted to each housing segment of the telescopic housing.

The mattress may be operated to adjust inflation of the bladder by detecting, with the sensor, movement of the cover of the mattress caused by at least one of the mattress support sections of the bed frame changing length or width. The sensor may then input to the pneumatic controller a signal to indicate that a mattress support section of the bed frame has changed length or width. The controller may inflate or deflate the bladder in response to the signal. In some embodiments, the sensor may be operable to signal the pneumatic controller that movement of a portion of the cover has been caused by movement of the bed frame to laterally widen or narrow at least one of the mattress support sections of the bed frame. In some embodiments, some or all of the sensor may be located outside the interior region of the mattress. In some embodiments, multiple sensors of the type discussed above may included with the mattress to sense movement of various mattress sections.

Additional features, which alone or in combination with any other feature(s), such as those listed above and those listed in the claims, may comprise patentable subject matter and will become apparent to those skilled in the art upon consideration of the following detailed description of various embodiments exemplifying the best mode of carrying out the embodiments as presently perceived.

BRIEF DESCRIPTION OF THE DRAWINGS

The detailed description particularly refers to the accompanying figures in which.

DETAILED DESCRIPTION OF THE DRAWINGS

Figure 1:
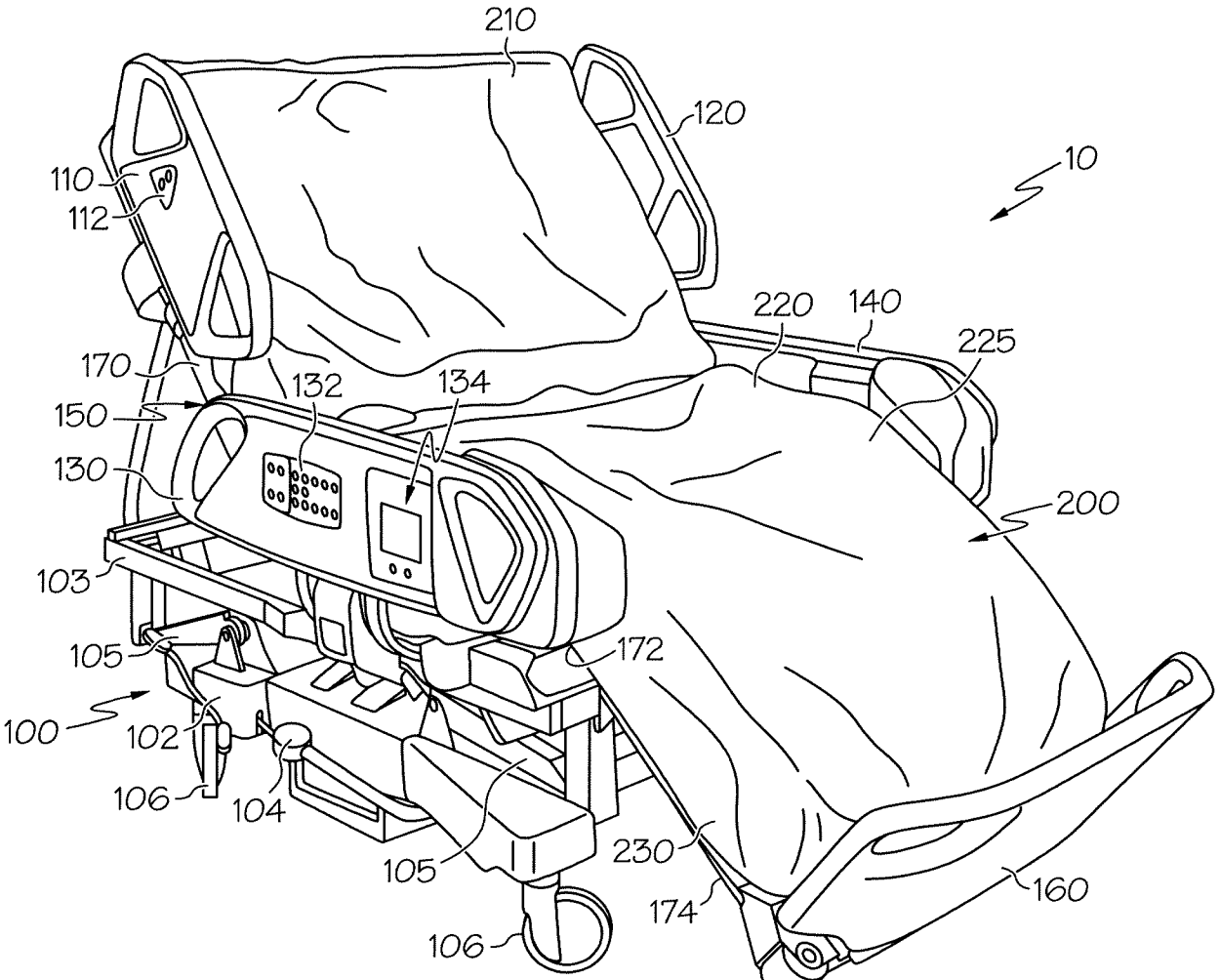
FIG. 1 is a perspective view of a patient support apparatus including a bed frame and a mattress or patient support surface supported on the bed frame.

Referring to FIG. 1, a hospital bed 10 includes a base 100, head section siderails 110, 120, body section siderails 130, 140, and a footboard 160. Bed 10 further includes a deck 150 divided into a head deck section 170, a thigh deck section 172, and a foot deck section 174. In the example of FIG. 1, which happens to illustrate Hill-Rom's TOTALCARE® bed, a seat section (not shown) is situated between head deck section 170 and thigh deck section 172. Foot deck section 174 is extendable and retractable. Such extension and retraction occurs, for example, when deck 150 of bed 100 is moved between a horizontal position and a chair position. Foot section 174 is also extendable and retractable when deck 150 is in other positions, such as the horizontal position, a Trendelenburg position, or a reverse Trendelenburg position. Additional details of the extendable and retractable foot section 174 of bed 10 can be found in U.S. Pat. Nos. 6,212,714; 6,163,903; and 5,715,548; each of which is hereby expressly incorporated by reference herein.

Base 100 includes base frame 102, control pedal 104, and casters 106 that support the bed 10. Foot deck section 174 includes bumpers or rollers 176. The head section siderails 110, 120 are coupled to head deck section 170 for motion therewith. Head section siderail 110 includes head-end controls 112 and siderail 120 includes similar controls (not shown). The siderails 130, 140 are coupled to an upper frame 103 that is situated above base frame 102. Siderail 130 includes siderail controls 132 and display 134. Lift arms 105 interconnect frames 102, 103 and are movable via suitable actuators (not shown), such as hydraulic actuators or electrically powered linear actuators, to raise, lower, and tilt upper frame 103 relative to base frame 102. Thus, base frame 102, upper frame 103, lift arms 105, and deck sections 170, 172, 174, as well as the seat deck section (not shown) cooperate to serve as a bed frame of bed 10 in the illustrative example. Deck sections 170, 172, 174 and the seat section may sometimes be referred to as mattress support sections.

Although the bed frame in the illustrative example is a Hill-Rom TOTALCARE® bed frame as mentioned previously, it should be appreciated that mattresses according to the present disclosure may be used with other types of bed frames, including the bed frames of Hill-Rom's VERSACARE® and EXCELCARE® bed, just to name a couple. Additional details of Hill-Rom's VERSACARE® bed can be found in U.S. Pat. Nos. 7,296,312 and 6,957,461, each of which is hereby expressly incorporated by reference herein and additional details of Hill-Rom's EXCELCARE® bed can be found in U.S. Pat. Nos. 7,464,425 and 7,237,284, each of which is hereby expressly incorporated by reference herein.

Supported on the deck 150 is a patient support surface 200. Patient support surface 200 is bounded by a head end 202, a foot end 203, a first side 204, a second side 205, a top 206, and a bottom 207. Patient support 200 includes a head support zone 210, a seat support zone 220, a thigh support zone, and a foot support zone 230. Head support zone 210 substantially overlies head deck section 170. Seat support zone 220 substantially overlies the seat deck section (not shown) of bed 10. Thigh support zone 225 overlies thigh deck section 172 and foot support zone 230 substantially overlies foot deck section 174. Head-end rails 110, 120 are arranged along opposing longitudinal sides of head support zone 210. Siderails 130, 140 are arranged along opposing longitudinal sides of seat support zone 220 and thigh support zone 225. Footboard 160 is arranged along the foot end 203 of patient support 200.

Figure 2:
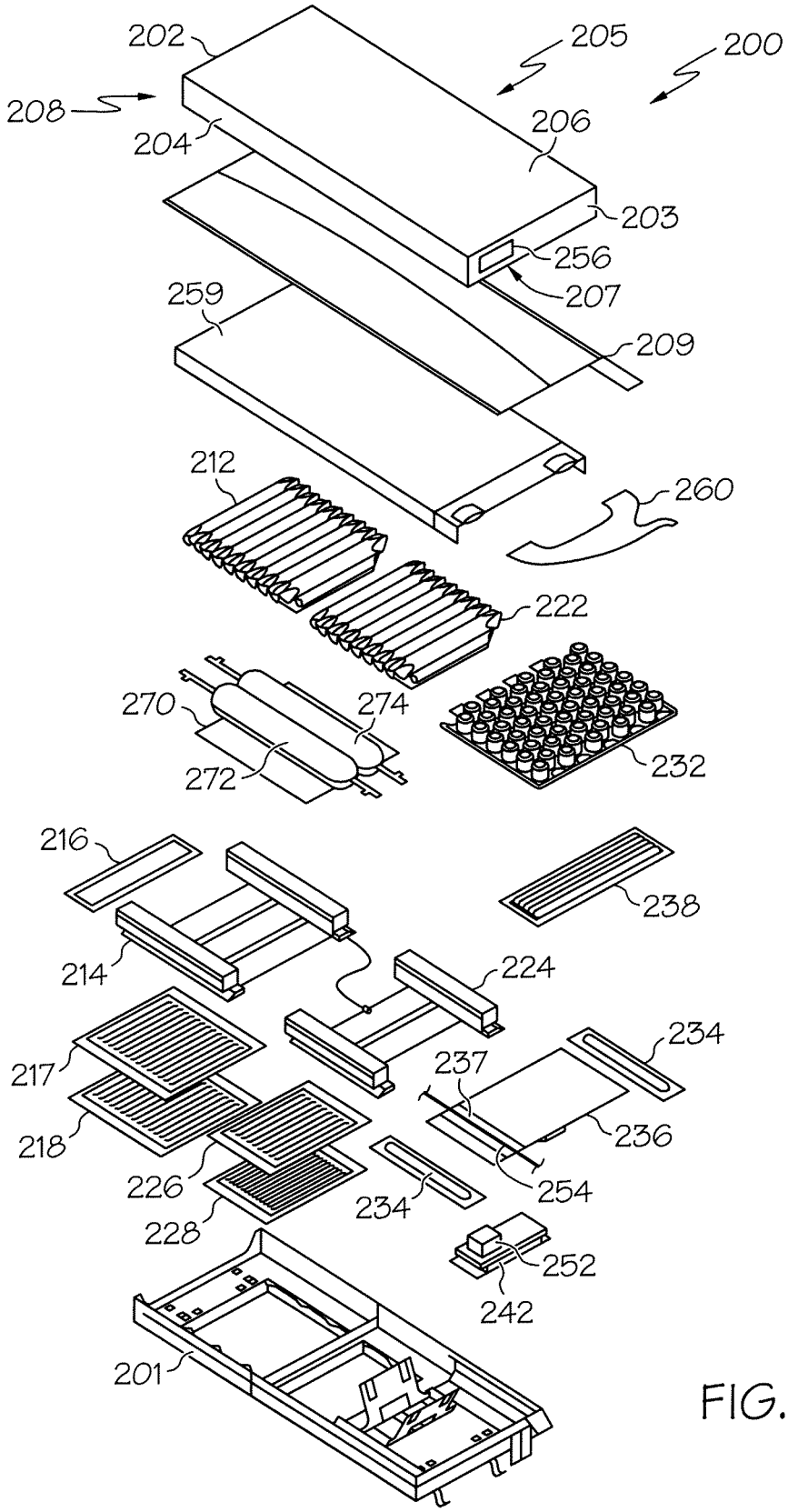
FIG. 2 is an exploded view of an embodiment of a patient support surface.

Referring now to FIG. 2, patient support 200 comprises a lower casement 201 that generally underlies the other support components and an upper cover 208 that cooperates with the lower casement to enclose the other support components of mattress 200. Lower casement 201 and upper cover 208 couple together, such as via a zipper, and are sometimes referred to as a coverlet in the art. Patient support 200 also comprises a fire-resistant barrier 209, a low air loss topper 259, and a low air loss supply manifold 260, each of which is located below the top portion 206 of the cover 208. Patient support 200 further includes a turn assist bladder assembly 270 comprising a left and a right turn assist bladder 272, 274.

Turn assist bladder assembly 270 may be controlled to provide assistance to a caregiver when turning a patient situated on patient support 200, such as to change the bed sheets. In order to assist a caregiver in turning a patient, either left turn assist bladder 272 or right turn assist bladder 274 is inflated on a one-time basis to lift the respective left or right side of a patient. The inflation of a turn assist bladder 272, 274 may be initiated upon a caregiver input to the siderail controls 132.

Additionally, in some embodiments, turn assist assembly 270 may be controlled to provide continuous lateral rotation therapy (CLRT) to a patient situated on patient support 200. CLRT is achieved by inflating and deflating left turn assist bladder 272 and right turn assist bladder 274 so as to cause a patient supported on patient support 200 to repeatedly rotate from a left turned position to a right turned position. The inflation of a turn assist bladder 272, 274 may be initiated upon a caregiver input to the siderail controls 132 or upon a preprogrammed schedule input via siderail controls 132. Turn assist assembly 270 may be disabled from functioning when head deck section 170 is inclined to greater than 30° relative seat deck section 172 in some embodiments.

Low air loss supply manifold 260 is configured to provide low air loss therapy to a patient supported on patient support 200 through low air loss topper 259. Low air loss topper 259 and manifold 260 provides a substantially evenly distributed flow of air that is leaked through perforations in the top portion 206 of patient support 200 in some embodiments or that is blown beneath top portion 206 to enhance evaporation of moisture away from top portion 206 in other embodiments. Low air loss therapy may be initiated upon a caregiver input to the siderail controls 132 or upon a preprogrammed schedule input via siderail controls 132.

Head support zone 210 comprises inflatable head bladders 212, head bolster foam 214, a head-end filler bladder 216, an upper head deck filler bladder 217, and a lower head deck filler bladder 218. Head bladders 212 may be tubular and may extend laterally across the patient support 200 parallel to the bottom 207 of the cover 208. Head bolster foam 214 is configured to support a patient along the longitudinal edges of the head deck section 170. Head deck filler bladders 217, 218 are configured to be inflated to raise head support 210 relative to head deck section 170.

Seat and thigh support zones 220, 225 comprise inflatable bladders 222, seat bolster foam 224, upper seat filler bladder 226, and lower seat filler bladder 228. Bladders 222 may be tubular and may extend laterally across the patient support 200 parallel to the bottom 207 of the cover 208. Seat bolster foam 224 is configured to support a patient along the longitudinal edges of the seat and thigh deck sections. Seat deck filler bladders 226, 228 are configured to be inflated to raise seat support 220 relative to seat deck section 172.

Foot support zone 230 comprises inflatable foot bladders 232, foot bolster bladders 234, foot filler foam 236, and calf filler bladder 238. Each of the inflatable foot bladders 232 is substantially annular and extends upwardly along a respective vertical axis substantially perpendicular to the bottom 207 of the cover 208 in the illustrative example. In other embodiments, foot support zone 230 has laterally extending bladders similar to bladders 212, 222, for example. Foot bolster bladders 234 are configured to support a patient along the longitudinal edges of the foot deck section 174. Calf filler bladder 238 is configured to be inflated to raise a patient's lower legs and feet relative to foot deck section 174.

In the illustrative example, mattress 200 has a controller and pneumatic valve box 242 which contains electrical circuitry and valves to control the inflation and deflation of that various bladders 212, 216, 217, 218, 222, 226, 228, 232, 234, 238, 272, 274. Box 242 is contained within the foot support zone 230 of mattress 200 in the illustrative example. An air source 246, such as a pump, compressor or blower, illustrated diagrammatically in FIG. 7 as blower 246, is housed in a separate housing (not shown) that hangs on a foot board of a bed, such as footboard 160 of bed 10, for example. Air source 246 is coupled pneumatically to box 242 and inflates the bladders 212, 216, 217, 218, 222, 226, 228, 232, 234, 238, 272, 274 through a series of pneumatic valves that are opened and/or closed via signals from the electrical circuitry of a pneumatic controller 240 which is also illustrated diagrammatically in FIG. 7.

Figure 7:
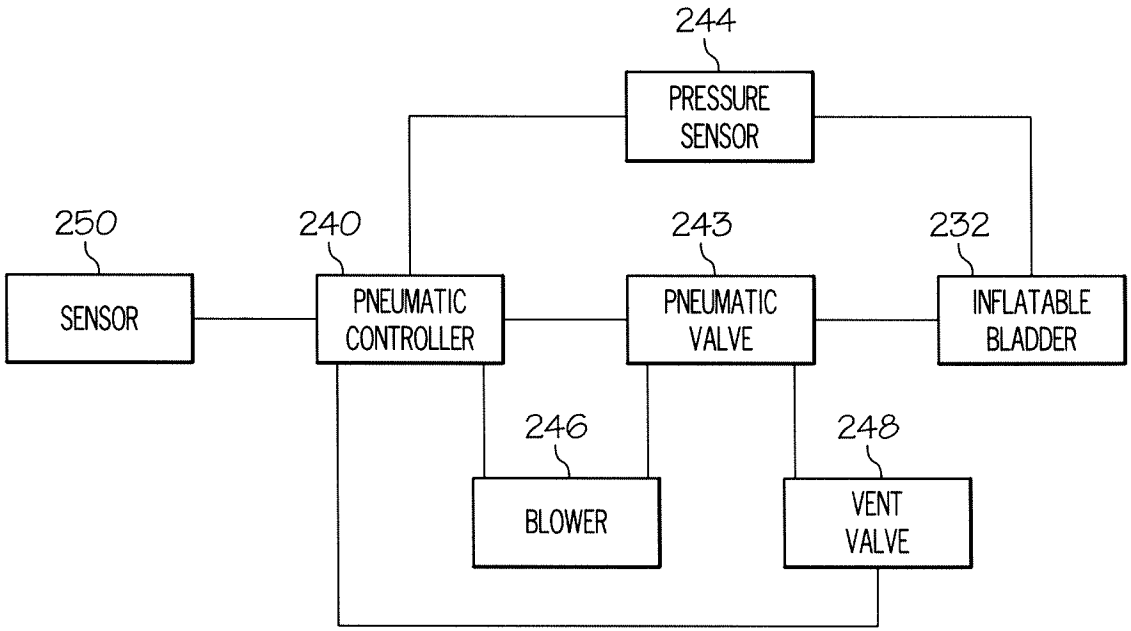
FIG. 7 is a block diagram of a pneumatic control system of a patient support surface.

A pneumatic valve 243 is shown diagrammatically in FIG. 7 and is coupled pneumatically to bladder 232 of foot support zone 230 of mattress 200. However, it should be understood that multiple such valves are included in the pneumatic valve box 242 of mattress 200 and are coupled to other associated bladders 212, 216, 217, 218, 222, 226, 228, 234, 238, 272, 274 of mattress 200. In some embodiment, multiple air sources such as for example, a blower and a separate pump or compressor are included in the pneumatic control system of mattress 200 to inflate respective subsets of bladders 212, 216, 217, 218, 222, 226, 228, 232, 234, 238, 272, 274.

Based on the foregoing, it will be understood that mattress 200 has its own pneumatic control system which operates independently of the control system of the bed frame of bed 10. Thus, mattress 200 is a so-called mattress replacement system which is controlled without communications with the control system of bed 10. While illustrative mattress 200 has box 242 situated within foot support zone 230 and has a separate housing (not shown) which contains air source(s) 246 as well as additional electrical circuitry (not shown) and a user interface (not shown), embodiments in which all of the control system components are located within the interior of mattress 200, embodiments in which all of the control system components are located within a separate housing outside of the interior of mattress 200, as well as control system embodiments between these two extremes, are contemplated as being within the scope of this disclosure. Additional details of mattress 200, which is marketed by Hill-Rom Company, Inc. as the ENVISION® E700 mattress, can be found in U.S. Patent Application Publication No. 2008/0028533 A1 which is hereby expressly incorporated by reference herein.

According to this disclosure, mattress 200 has a sensor 250 that is used to sense movement of a portion of mattress 200 caused as a result of one or more of deck sections of bed 10 extending or retracting. The sensor 250 is in communication with the pneumatic controller 240 as shown diagrammatically in FIG. 7. In the illustrative embodiment, sensor 250 is situated in the interior of mattress 200 below the foot bladders 232. Thus, in the illustrative example, sensor 250 senses movement of foot support zone 230 of mattress 200 due to extension or retraction of foot deck section 174 of bed 10. However, the same type of sensor 250 can be used in other portions of mattress to sense, for example, lateral extension or retraction of one or more deck sections 170, 172, 174 as well as the seat deck section (not shown).

Figure 3:
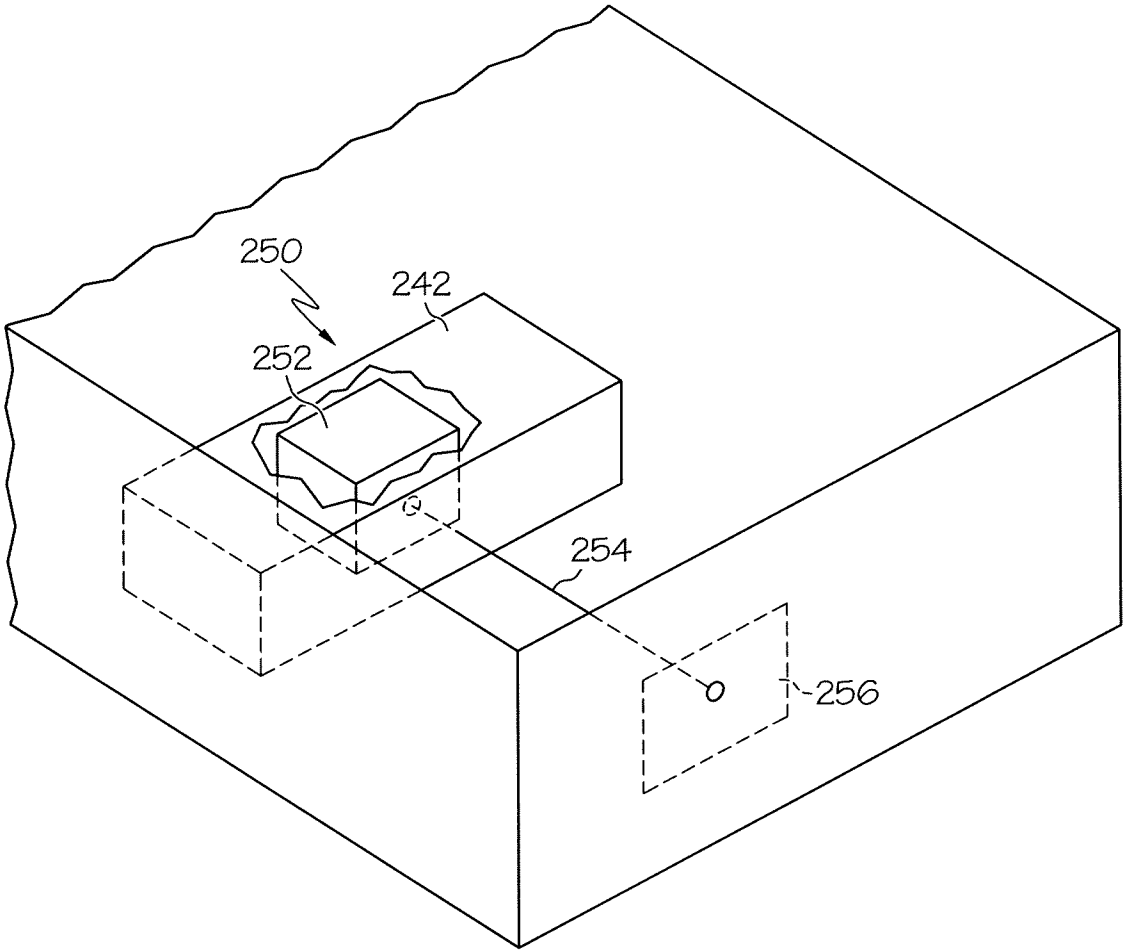
FIG. 3 is a partial perspective view of selected components of a patient support surface including a string potentiometer sensor embodiment.
Figure 4:
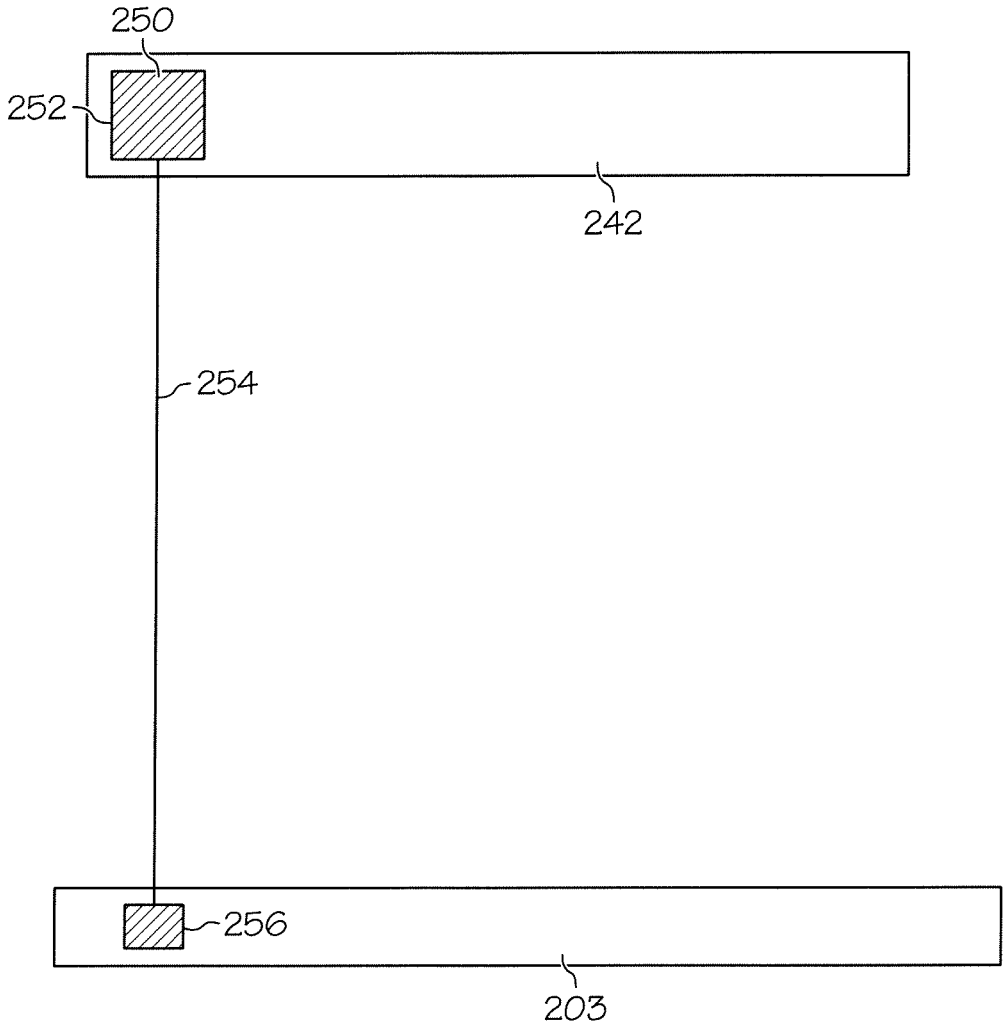
FIG. 4 is a diagrammatic view of selected components of a patient support surface including a string potentiometer sensor embodiment.

As shown in FIGS. 2-4, sensor 250 is embodied as a string potentiometer and includes a potentiometer unit 252, a string 254, and a mounting plate 256. In some contemplated embodiments, such as the embodiment shown in FIG. 2, sensor unit 250 is coupled to, and situated above, the pneumatic valve box 242. In such an embodiment, foot filler foam 236 has a void 237 to accommodate a portion of string 254 of sensor unit 250 below the foot bladders 232. In other contemplated embodiments, such as the embodiment shown in FIG. 3, sensor unit 250 is situated within the pneumatic valve box 242. The mounting plate 256 is coupled to an inner surface of the foot end 203 of the cover 208 as suggested in FIG. 3. The string 254 extends between the potentiometer unit 252 and the mounting plate 256.

Potentiometer unit 252 has therein a rotary potentiometer with a shaft or post, which optionally may also include a spool if desired, about which string 254 winds when plate 256 moves toward potentiometer 252. A biasing member, such as a clock spring, is included in potentiometer unit 252 and biases the shaft or post to rotate in a direction that has a tendency to retract string 254 into the potentiometer 252 by winding it on the shaft or post which is turned under the bias of the clock spring. When the string 254 is pulled out of potentiometer unit 252, it unwinds from the post or shaft against the bias of the clock spring, thereby turning the post or shaft of the rotary potentiometer. When the post or shaft turns due to string 254 retracting into potentiometer unit 252 or being pulled out of potentiometer unit 252, a resistance output value of the rotary potentiometer of potentiometer unit 252 changes.

In some embodiments of mattress 200, portions of mattress 200 are anchored or otherwise attached to the deck sections of deck 150. Thus, foot support zone 230 of mattress 200 has anchor members, such as straps, or other couplers, such as magnets, mechanical hooks, hook-and-loop fastener strips, and the like that interact with mating components or features on foot deck section 174. In use, therefore, when foot deck section 174 of deck 150 of bed 10 is retracted, thereby shortening the length of foot deck section 174, forces are imparted by the retracting deck section 174 on foot support zone 230, which forces have a tendency to shorten foot support zone 230. As a result, plate 256 is moved toward potentiometer unit 252 and string 254 is retracted into potentiometer unit 252 changing the resistance value of the rotary potentiometer contained within unit 252. This change in resistance is sensed by pneumatic controller 240 which then controls the pneumatic system to deflate, at least partially, one or more of bladders 232, 238, 234 included in foot support zone 230. The extent of deflation of bladders 232, 238, 234, and/or the number of bladders 232, 238, 234 that are deflated, is dependent upon the extent to which plate 256 is moved toward potentiometer unit 252, which ultimately is dependent upon the extent of retraction or shortening of foot deck section 174.

When foot deck section 174 of deck 150 of bed 10 is extended, thereby increasing the length of foot deck section 174, forces are imparted by the extending deck section 174 on foot support zone 230 having a tendency to lengthen foot support zone 230. As a result, plate 256 is moved away from potentiometer unit 252 and string 254 is pulled out of potentiometer unit 252 changing the resistance value of the rotary potentiometer contained within unit 252. This change in resistance is sensed by pneumatic controller 240 which then controls the pneumatic system to inflate, at least partially, one or more of the bladders 232, 238, 234 included in foot support zone 230. The extent of inflation of bladders 232, 238, 234, and/or the number of bladders 232, 238, 234 that are inflated, is dependent upon the extent to which plate 256 is moved away from potentiometer unit 252, which ultimately is dependent upon the extent of extension or lengthening of foot deck section 174.

Figure 5:
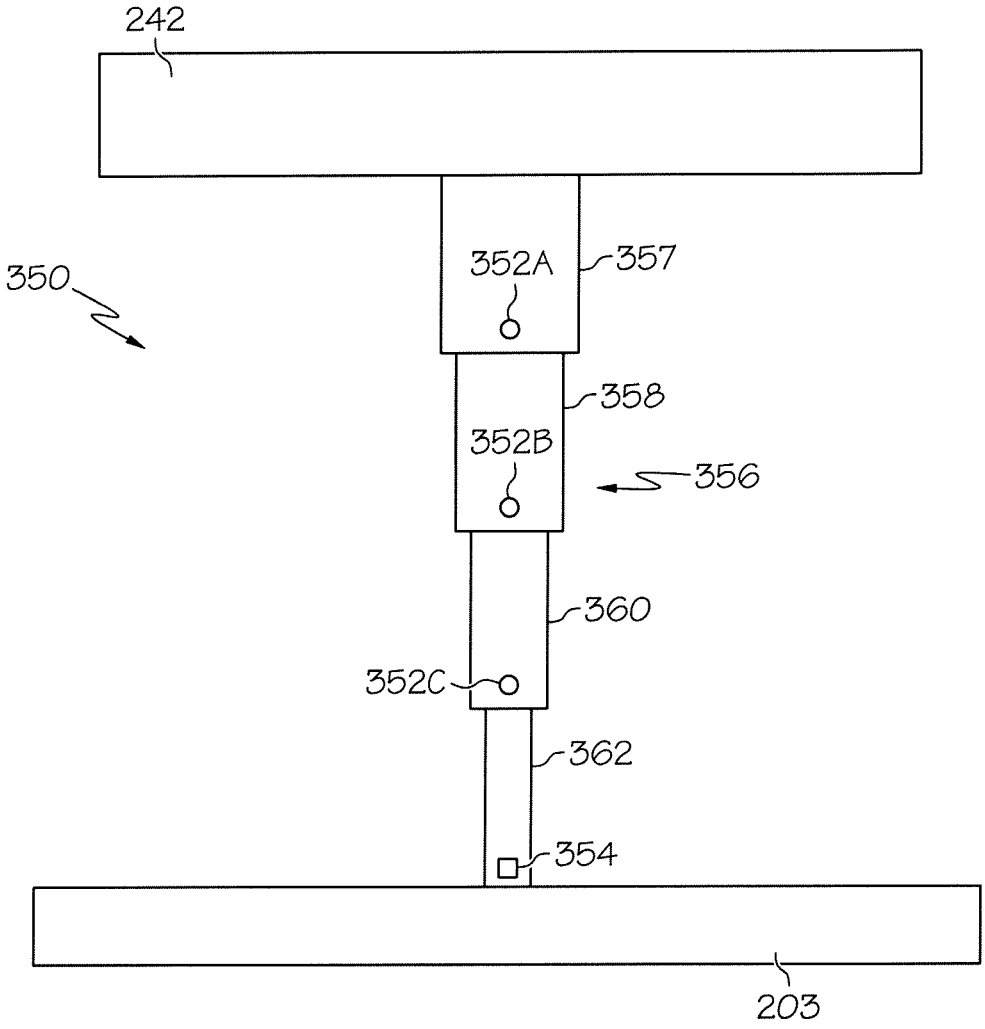
FIG. 5 is a diagrammatic view of selected components of a patient support surface including a Hall Effect sensor embodiment.
Figure 6:
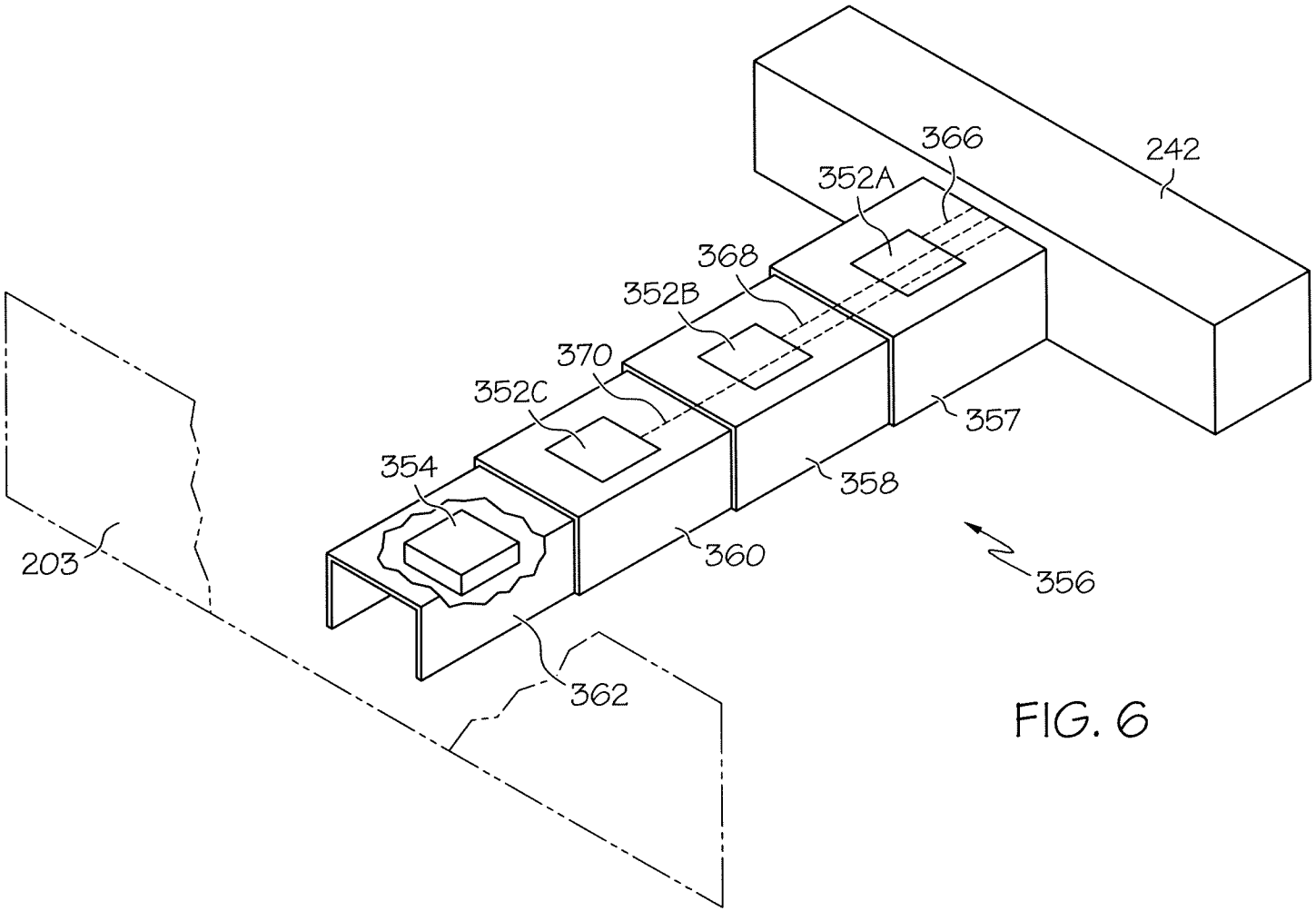
FIG. 6 is a partial perspective view of selected components of a patient support including a Hall Effect sensor embodiment.

In an alternative embodiment, shown in FIGS. 5 and 6, a sensor 350 is disposed between the pneumatic valve box 242 and the foot end 203 of the patient support. Sensor 350 comprises Hall Effect sensors 352A, 352B, 352C, a magnet 354, and a telescopic housing 356. Housing 356 is made of a plastics material in some embodiments, for example. The Hall Effect sensors 352A, 352B, 352C are spaced along the retractable housing 356 between the pneumatic valve box 242 and the foot end 203 of the patient support 200.

The telescopic housing 356 is made up of nested U-shaped sensor housing segments 357, 358, 360 and a nested U-shaped magnet housing segment 362. Each Hall Effect sensor 352A, 352B, 352C is coupled to a respective one of the U-shaped sensor housing segments 357, 358, 360. The magnet 354 is situated near the foot end 203 of the patient support 200 and is coupled to the interior portion of the U-shaped magnet housing segment 362 as shown best in FIG. 6. Hall Effect sensors 352A, 352B, 352C are individually coupled to the pneumatic controller 240 via lines or wires 366, 368, 370, respectively, a portion of which is shown (in phantom) in FIG. 6. Wires 366, 368, 370 may be routed through the retractable plastic housing 356 in some embodiments.

U-shaped sensor housing segment 357 is situated nearest the pneumatic valve box 242 and is the largest of the U-shaped sensor housing segments in the illustrative example. U-shaped sensor housing segment 358 is slightly smaller than U-shaped sensor housing segment 357 and is configured to slide along the inside of U-shaped sensor housing segment 356. U-shaped sensor housing segment 360 is, in turn, slightly smaller than U-shaped sensor housing segment 358 and is configured to slide along the inside of U-shaped sensor housing segment 358. U-shaped magnet housing segment 362 is the smallest of the nested telescopic housing segments 357, 358, 360, 362 and is configured to slide along the inside of U-shaped sensor housing segment 360. The U-shaped magnet housing segment 362 is situated nearest the foot end 203 of patient support 200.

Segments 357, 358, 360, 362 of telescopic housing 256 are sized and configured so that when foot section 230 of mattress 200 is in its fully extended position, telescopic housing 256 is in its fully extended position as shown in FIGS. 5 and 6. As foot section 230 is retracted, due to the retraction of foot deck section 174 as described above, magnet 354 moves first to a position beneath Hall Effect Sensor 352C. Hall Effect Sensor 352C senses the presence of magnet 354 and provides a corresponding signal on line 370. Further retraction of foot section 230 of mattress 200 moves magnet 354 to a position beneath Hall Effect sensor 352B which then provides a corresponding signal on line 368 indicating the presence of magnet 354. Finally, as foot section 230 of mattress 200 reaches or nears its fully retracted position, magnet 354 moves to a position beneath Hall Effect sensor 352A which then provides a corresponding signal on line 366 indicating the presence of magnet 354.

In response to the foot section 230 extending from its fully retracted position to the fully extended position, the reverse occurs. That is, magnet 354 moves out from under Hall Effect sensor 352A and a signal indicating the absence of magnet 354 is provided on line 366. Further extension of foot section 230 of mattress 200 causes magnet 354 to move out from under Hall Effect sensor 352B and a corresponding signal indicating the absence of magnet 354 is provided on line 368. Finally, as foot section 230 of mattress 200 reaches or nears its fully extended position, magnet 354 moves out from under Hall Effect sensor 352C and a corresponding signal indicating the absence of magnet 354 is provided on line 370.

Lines 366, 368, 370 provide signals to pneumatic controller 240 which then controls the pneumatic system to either deflate, at least partially, one or more of the bladders 232, 238, 234 included in foot support zone 230 as the foot section 230 is retracted or to inflate, at least partially, one or more of the bladders 232, 238, 234 included in foot support zone 230 as the foot section 230 is extended. The extent of deflation or inflation of bladders 232, 238, 234, and/or the number of bladders 232, 238, 234 that are deflated or inflated, is dependent upon which of Hall Effect sensors 352A, 352B, 352C is sensing the presence or absence of magnet 354.

As mentioned previously, patient support 200 comprises a pneumatic controller 240 as shown diagrammatically in FIG. 7. The pneumatic controller 240 is in communication with and controls the pneumatic valve 243 situated in the interior region of the patient support 200. Additionally, the pneumatic controller 240 is in communication with and controls blower 246 and a vent valve 248 as also shown diagrammatically in FIG. 7. The pneumatic valves, similar to valve 243, of valve box 242 are pneumatically coupled to each of the bladders making up the head bladders 212, percussion and vibration bladders 216, torso bladders 218, seat bladders 222, and thigh bladders 224 as alluded to previously. Pneumatic controller 240 is also in communication with pressure sensors 244 that sense the pressures in the head bladders 212, percussion and vibration bladders 216, torso bladders 218, seat bladders 222, thigh bladders 224, and foot bladders 232.

In response to the retraction or extension of the foot deck section 174, the foot bladders 232 of the foot section 230 may be deflated or inflated so that the foot bladders 232 constantly overlie but do not extend beyond the foot section 230. One method of deflating and inflating the foot bladders 232 includes the sensor 250 detecting movement of the cover 208 at the foot end of the patient support 203. The sensor 250 may communicate the movement of the cover 208 via a signal to the pneumatic controller 240 to indicate that the foot deck section 174 has changed length. The pneumatic controller 240 may deflate or inflate individual or multiple foot bladders 232 in response to the communicated direction and magnitude of cover 208 movement.

In order to deflate individual foot bladders 232, pneumatic controller 240 may open vent 248 and control pneumatic valve 243 so as to connect the foot bladders 232 with ambient air allowing the pressure in foot bladders 232 to bleed to atmosphere. In order to inflate individual foot bladders 232, pneumatic controller 240 may turn on blower 246 and control pneumatic valve 243 so as to connect the foot bladders 232 with blower 246. Connection of the blower 246 to bladders 232 through valve 243 to inflate bladders 232 may be maintained until the pressure in foot bladders 232, as measured by the pressure sensor 244 associated with the bladders 232, reaches a desired level. During inflation of bladders 232, vent valve 248 is closed.

It is within the scope of this disclosure to use sensors 250, 350 in mattresses that are less complex than illustrative mattress 200. For example, mattresses in which turn assist bladder assembly 270 is omitted and/or in which low air loss topper 259 and manifold 260 are omitted are contemplated by this disclosure. Furthermore, mattresses having only a single layer of air bladders may make use of sensors 250, 350 in accordance with the teaching of this disclosure. Furthermore, in those embodiments in which sensors 250, 350 are used to sense lateral extension or retraction of an associated mattress support deck section, it will be appreciated that sensors 250, 350 are oriented laterally within the associated mattresses rather than longitudinally. More particularly, with regard to sensor 250, the string 254 of sensor 250 is oriented laterally and plate 256 would be coupled to a sidewall of the mattress coverlet rather than an end wall and, with regard to sensor 350, the telescopic housing 356 is oriented so as to telescopically extend and retract laterally rather than longitudinally. It is also contemplated by this disclosure that multiple sensors 250 and/or sensors 350 may be included in a mattress to sense lateral extension and retraction of associated mattress sections and/or to sense longitudinal extension and retraction of associated mattress sections.

Although patient support surface apparatuses and associated methods have been described in detail with reference to certain illustrative embodiments, variations and modifications exist within the scope and spirit of this disclosure as described and defined in the following claims.

The invention claimed is:

1. A mattress for use on a bed frame having mattress support sections including a linearly extendable and retractable foot section, the mattress comprising:

a cover having an interior region, at least one inflatable bladder situated in the interior region, a pneumatic controller configured to inflate and deflate the at least one inflatable bladder, and a sensor situated in the interior region such that a portion of the cover is situated beneath the sensor and between the sensor and the bed frame, the sensor being operable to signal the pneumatic controller that movement of a foot portion of the cover caused by movement of the bed frame to linearly extend or retract the foot section has been detected, the pneumatic controller operating to inflate or deflate the at least one inflatable bladder in response to receipt of the signal.

2. The mattress of claim 1, wherein the sensor is situated in the interior region beneath the at least one inflatable bladder.

3. The mattress of claim 1, wherein the sensor comprises a string potentiometer.

4. The mattress of claim 3, wherein the pneumatic controller includes a valve box situated in the interior region and the string potentiometer includes a housing coupled to the valve box.

5. A mattress for use on a bed frame having mattress support sections including a linearly extendable and retractable foot section, the mattress comprising:

a cover having an interior region, at least one inflatable bladder situated in the interior region, a pneumatic controller configured to inflate and deflate the at least one inflatable bladder, a sensor situated in the interior region and operable to signal the pneumatic controller that movement of a foot portion of the cover caused by movement of the bed frame to linearly extend or retract the foot section has been detected, the pneumatic controller operating to inflate or deflate the at least one inflatable bladder in response to receipt of the signal, wherein the sensor comprises a string potentiometer, wherein the pneumatic controller includes a valve box situated in the interior region and the string potentiometer includes a housing coupled to the valve box, and a mounting plate coupled to a foot end wall of the cover and the string potentiometer has a string extending from the housing and attached to the mounting plate.

6. A mattress for use on a bed frame having mattress support sections including a linearly extendable and retractable foot section, the mattress comprising:

a cover having an interior region, at least one inflatable bladder situated in the interior region, a pneumatic controller configured to inflate and deflate the at least one inflatable bladder, and a sensor situated in the interior region and operable to signal the pneumatic controller that movement of a foot portion of the cover caused by movement of the bed frame to linearly extend or retract the foot section has been detected, the pneumatic controller operating to inflate or deflate the at least one inflatable bladder in response to receipt of the signal, wherein the sensor comprises a string potentiometer, wherein the pneumatic controller includes a valve box situated in the interior region and the string potentiometer includes a housing coupled to the valve box, wherein the string potentiometer has a string extending from the housing and the string has an end coupled to a foot end wall of the cover.

7. A mattress for use on a bed frame having mattress support sections including a linearly extendable and retractable foot section, the mattress comprising:

a cover having an interior region, at least one inflatable bladder situated in the interior region, a pneumatic controller configured to inflate and deflate the at least one inflatable bladder, and a sensor situated in the interior region and operable to signal the pneumatic controller that movement of a foot portion of the cover caused by movement of the bed frame to linearly extend or retract the foot section has been detected, the pneumatic controller operating to inflate or deflate the at least one inflatable bladder in response to receipt of the signal, wherein the sensor comprises a string potentiometer, wherein the pneumatic controller includes a valve box situated in the interior region and the string potentiometer includes a housing coupled to the valve box, and a mounting plate coupled to a bottom layer of the cover near a foot end wall of the cover and the string potentiometer has a string extending from the housing and attached to the mounting plate.

8. A mattress for use on a bed frame having mattress support sections including a linearly extendable and retractable foot section, the mattress comprising:

a cover having an interior region, at least one inflatable bladder situated in the interior region, a pneumatic controller configured to inflate and deflate the at least one inflatable bladder, and a sensor situated in the interior region and operable to signal the pneumatic controller that movement of a foot portion of the cover caused by movement of the bed frame to linearly extend or retract the foot section has been detected, the pneumatic controller operating to inflate or deflate the at least one inflatable bladder in response to receipt of the signal, wherein the sensor comprises a string potentiometer, wherein the pneumatic controller includes a valve box situated in the interior region and the string potentiometer includes a housing coupled to the valve box, wherein the string potentiometer has a string extending from the housing and the string has an end coupled to a bottom layer of the cover near a foot end wall of the cover.

9. The mattress of claim 1, wherein the at least one bladder comprises a plurality of inflatable bladders, each bladder extending upwardly along a respective vertical axis, the vertical axes of the plurality of inflatable bladders being substantially perpendicular to a bottom surface of the cover.

10. The mattress of claim 1, wherein the sensor comprises at least one Hall Effect sensor and a magnet.

11. The mattress of claim 10, wherein the sensor further includes a retractable housing coupled to the Hall Effect sensor and the magnet.

12. The mattress of claim 11, wherein the retractable housing has a first end adjacent a foot end wall of the cover.

13. The mattress of claim 11, wherein the pneumatic controller comprises a valve box situated in the interior region of the cover and the retractable housing is situated between the valve box and a foot end wall of the cover.

* * * * *